United States Patent [19]

James

[11] Patent Number: 4,638,617

[45] Date of Patent: Jan. 27, 1987

[54] REFRACTORY CURTAIN WALL

[75] Inventor: Barry R. James, Apple River, Ill.

[73] Assignee: Merkle Engineers, Inc., Galena, Ill.

[21] Appl. No.: 662,576

[22] Filed: Oct. 19, 1984

[51] Int. Cl.[4] ..... E04C 1/04; E06B 3/54

[52] U.S. Cl. ..... 52/474; 52/486; 52/574; 52/609; 110/338

[58] Field of Search ..... 52/235, 574, 575, 596, 52/608, 609, 716, 238, 486, 474; 110/338

[56] References Cited

U.S. PATENT DOCUMENTS

| | | | |
|---|---|---|---|
| 1,097,148 | 5/1914 | Swanson | 52/574 |
| 1,410,729 | 3/1922 | Balz | 110/338 |
| 1,553,004 | 9/1925 | Packard | 52/574 |
| 1,585,003 | 5/1926 | Wilson et al. | 52/328 |
| 2,827,784 | 3/1958 | Lambert | 52/486 |
| 2,884,780 | 5/1959 | Ramirez | 52/574 |
| 2,942,453 | 6/1960 | Kaul | 52/574 |
| 2,987,856 | 6/1961 | Longenecker | 52/609 |
| 3,132,447 | 5/1964 | Hosbein | 52/574 |
| 3,308,595 | 3/1964 | Markrow | 52/596 |
| 3,557,505 | 1/1971 | Kaul | 52/608 |
| 4,411,621 | 10/1983 | Miller | 52/574 |

*Primary Examiner*—John E. Murtagh
*Assistant Examiner*—Andrew Joseph Rudy
*Attorney, Agent, or Firm*—Thomas W. Speckman

[57] ABSTRACT

A vertically suspended refractory curtain wall having two courses of refractory shapes, the refractory shapes having flat exposed faces and an opposite face having a horizontal central recess, the portion of the refractory extending above the recess forming an upper hanger portion and the portion of the refractory extending below the recess forming a lower hanger portion, the lower hanger portions of one horizontal row of first course of refractory shapes fitting within the upper portion of the horizontal recess of an opposing horizontal row of side-by-side refractory shapes forming a second course and suspending that row, the next adjacent lower row of the first course of refractory shapes having their upper hanger portions fitting within the lower portion of the horizontal recess of the same second course refractory shapes and are suspended thereby, and so on, to form a vertically suspended refractory curtain wall. The refractory curtain wall provides a structure having smooth faces on both sides, which is self-supporting without the need of side bucking, and has no straight through joints. The refractories on opposite sides of the wall may be of different quality, if desired.

20 Claims, 3 Drawing Figures

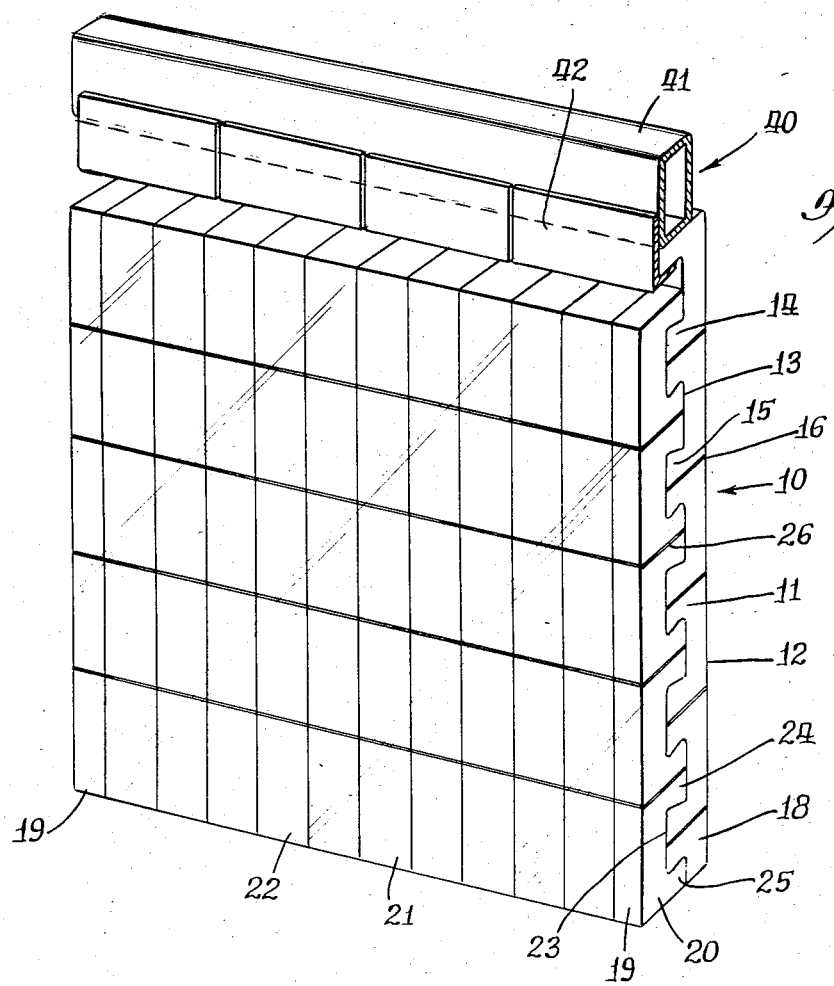
Fig. 1.
Fig. 2.
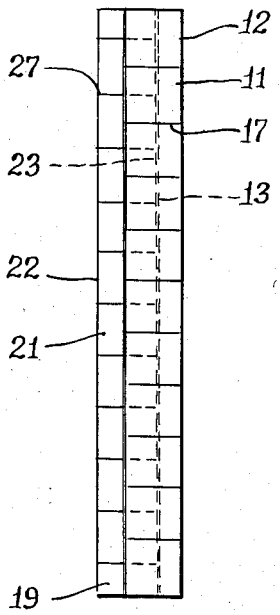
Fig. 3.
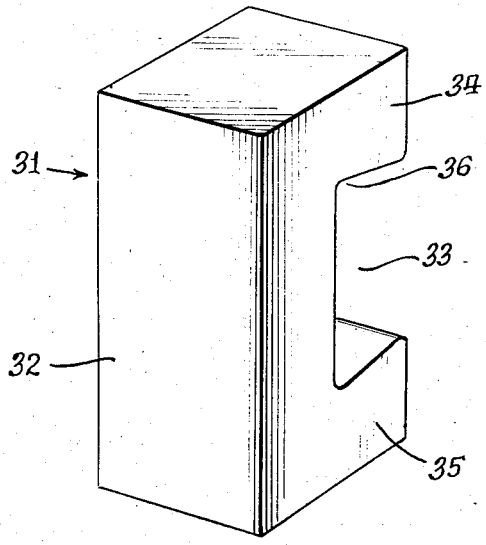

REFRACTORY CURTAIN WALL

BACKGROUND OF THE INVENTION

1. Field of the Invention

A vertically suspended refractory curtain wall for use in high temperature furnaces which provides a vertically suspended refractory wall structure having smooth faces on both sides and which is self-supporting without the need of side bucking. The refractory curtain wall of this invention has no straight through joints and the refractories on opposite sides may be of different quality.

2. Description of the Prior Art

Refractory curtain walls may be subjected to heat on both sides, such as when used as burner port dampers where the wall is used to block off the flow of gases from the furnace, or they may be exposed to heat on only one side, such as when used as walls or doors of a forge furnace or heat treating furnace. Prior methods of construction for vertically suspended refractory curtain walls are exemplified by U.S. Pat. No. 2,987,856 and U.S. Pat. No. 3,132,447. Both of these patents teach a curtain wall construction wherein the refractory shapes have treads on the sides and joints perpendicular to the face of the wall. The upper refractories are supported by means of metallic hangers engaging the side treads of alternate vertical rows of refractory shapes forming alternate hanger and filler vertical rows. The thickness of the wall is determined by the length of the refractory used and requires side bucking to keep the refractories in place at the end of the wall, that is, to prevent the wall from unraveling. Mismatch in the treads or spaces left between courses must be filled with mortar to prevent heat and gas leakage. U.S. Pat. No. 1,585,003 teaches a similar construction for tile arches and floors for high temperature furnaces.

The use of "dovetail type" joints in connection with the facing of refractory bricks is known as taught in U.S. Pat. Nos. 2,827,784 and 1,410,729.

SUMMARY OF THE INVENTION

This invention provides a vertically suspended refractory curtain wall which may be flat on both sides, requires no side bucking, and may have a different refractory quality on each face. The refractory curtain wall construction of this invention is self-aligning providing a smooth surface on both sides of the wall and has no straight through joints making it unnecessary to use mortar to fill voids or spaces. The hot face refractory may be chosen to resist one type of exposure while the cold face refractory may be chosen to fit another type of exposure, for instance, the hot face refractories may be chosen to resist abrasion, while the cold face refractories may be chosen to reduce heat loss. The vertically suspended refractory curtain wall of this invention makes it possible to build a curtain wall which may be lowered into position where both faces of the edges on both sides may be exposed to a high temperature environment, not requiring any framing or bucking structure. The vertically suspended refractory curtain wall of this invention requires support structure only at the top, which support structure may be cooled by passage of a cooling fluid, either gas or liquid.

These advantages are obtained by the suspended refractory curtain wall of this invention having two courses of refractory shapes; a first course having a plurality of adjacent horizontal rows each comprising a plurality of side-by-side rectangular refractory shapes, each having a flat exposed face and an opposite face having a horizontal central recess, the portion of the refractory extending above the recess forming an upper hanger portion and the portion of the refractory extending below the recess forming a lower hanger portion; and a second course having a plurality of adjacent horizontal rows each comprised of a plurality of refractory shapes of the same configuration as in the first course. In a central portion of the suspended refractory curtain wall, the lower hanger portions of one horizontal row of the first course fit within the upper portion of the horizontal recesses of one of the horizontal rows of the second course refractories, thereby suspending the second course refractories, and the upper hanger portions of an adjacent lower horizontal row of the first course refractories fitting within the lower portion of the same horizontal recess of the second course refractories thereby suspending the adjacent lower horizontal row of first course refractories. This interlocking feature provides support from one shape to the next. Horizontal displacement of the vertical joints between the side-by-side refractories of the first course as compared with the vertical joints between the side-by-side refractories of the second course, provides both added structural coherency to the curtain wall, eliminating the tendency for the wall to unravel, and results in no straight through joints, greatly reducing the need to use mortar to fill voids or spaces. The structure of the present invention having the refractory interlocking connections parallel to the plane of the curtain wall, is directly contrary to the prior art curtain walls wherein the interlocking connections of the refractories are at right angles to the plane of the curtain wall.

The vertically suspended refractory curtain wall of this invention requires only suspension from the top which may be achieved by a fluid cooled support hanger. The refractories in each of the two courses may be identical both in configuration and material, or they may be of different materials, or they may be of the same configuration but of different dimensions. The desired horizontal displacement may be easily obtained by use of vertical half-refractories at each end of each horizontal row of one course of refractories to offset that course from the opposing course of refractories by about one-half the width of the refractory. Likewise, the bottom of the curtain wall assembly may be easily finished by the last horizontal row of the first course of refractories being horizontal half refractories.

BRIEF DESCRIPTION OF THE DRAWING

The above and other advantages and objects of the invention will be better understood by reference to preferred embodiments and the drawing wherein:

FIG. 1 shows a perspective view of a curtain wall assembly according to one embodiment of this invention;

FIG. 2 shows a top view of the curtain wall assembly shown in FIG. 1 with the support hanger removed; and FIG. 3 is a perspective view of a typical refractory for use in the curtain wall of this invention.

DESCRIPTION OF PREFERRED EMBODIMENTS

Referring to FIG. 3, a refractory configuration suitable for use in this invention is shown as typical refractory 31 of generally rectangular shape and having flat exposed face 32. The opposite face has horizontal central recess 33 formed by upper hanger portion 34 and lower hanger portion 35 extending above and below the recess, respectively. In preferred embodiments, the walls of the upper hanger portion and lower portion forming recess 33 taper to provide greater height to the recess toward the central portion of the refractory by an amount of two times taper 36. In preferred embodiments, the depth of recess 33 is about one-half the thickness of the refractory shape. However, the vertically suspended refractory curtain wall of this invention may be constructed of refractories wherein the relative dimensions of the recess are quite different in proportion to the overall dimensions of the refractory than shown in FIG. 3. For example, the refractory may be considerably deeper or considerably wider in proportion to that shown in FIG. 3. The refractories may be made of any suitable material as known in the art.

Since the vertically suspended refractory curtain wall of this invention has two courses of refractories, the refractories in one course may be of a different quality than the refractories in the opposing course to achieve desired properties. Likewise, the refractories in one portion of a course of refractories may be of different quality than those in another portion of that course, for example, to provide desired differing characteristics at different heights of a high temperature furnace.

An important feature of the refractories used in the vertically suspended curtain wall of this invention is that they be of the general configuration shown in FIG. 3 and that they be sized to snugly interlock one course of refractories with a second course of refractories. It is also desired, in most cases, that the refractories of each course be sized to provide a flat face.

Referring to FIG. 1, refractory curtain wall 10 is shown suspended from support hanger 40. The vertically suspended refractory curtain wall 10 has two courses of refractories, a first course made up of refractories 11 and a second course made up of refractories 21. Each course of refractories has a plurality of adjacent horizontal rows of refractories each comprising a plurality of side-by-side rectangular refractory shapes. The refractory shapes have the general configuration described above with respect to FIG. 3. First course refractories 11 have flat exposed faces 12 and horizontal central recesses 13. Recess 13 is formed by upper hanger portion 14 and lower hanger portion 15 extending above and below recess 13. Likewise, second course refractories 21 have flat exposed faces 22 and horizontal recesses 23 formed by upper hanger portion 24 and lower portion 25 extending above and below the recess 23, respectively. It is seen in FIG. 1 that lower hanger portions 15 of one horizontal row of first course refractories 11 fit within the upper portion of horizontal recess 23 of one horizontal row of second course refractories 21 thereby suspending the second course refractories, and the upper hanger portions 14 of an adjacent lower horizontal row of first course refractories 11 fit within the lower portion of the same horizontal recesses 23 of the second course refractories 21 thereby suspending the adjacent lower horizontal row of the first course refractories 11. Repeat of suspending adjacent rows of second and first course refractories may be continued to achieve the desired horizontal height of a refractory curtain wall assembly as shown in FIG. 1.

It is seen that the suspended refractory curtain wall construction of this invention provides that the horizontal joint 16 between adjacent horizontal rows of first course refractory bricks 11 is spaced from horizontal joint 26 between adjacent horizontal rows of second course refractories 21. Further, a tortuous path through the horizontal joints is provided between first course refractory face 12 and second course refractory face 22. A similar offsetting of vertical joints is achieved by the suspended refractory curtain wall of this invention as shown in FIG. 2. As shown in FIG. 2, the vertical joints 17 between first course refractories 11 are offset from vertical joints 27 between second course refractories 21. Again, a tortuous path is provided between first course refractory face 12 and second course refractory face 22.

In FIG. 1 showing a vertically suspended refractory curtain wall assembly of this invention, the upper horizontal row of the first course refractories 11 has upper hanger portion 14 engaging hanger bracket 42 of support hanger 40. Any suitable hanger bracket may be used as long as it provides suspension of the upper horizontal row of the first course refractories. The embodiment shown in FIG. 1 is a preferred embodiment in which hanger bracket 42 depends from tube 41 which may be cooled by passage of any cooling fluid, gaseous or liquid, therethrough.

The ends of a suspended refractory curtain wall assembly, as shown in FIG. 1, may have exposed refractory ends without the need for any framework or side bucking providing the further advantage of only the support hanger 40 requiring protection from furnace heat. The ends of the curtain wall assembly may be easily rendered flat by utilizing a vertical half refractory 19 on each end of the horizontal row of one course. Likewise, the bottom of the suspended refractory curtain wall assembly may be rendered flat by utilization of a horizontal half refractory as the bottom horizontal row of the first course of refractories. Again, it is not usually necessary, or desirable, to provide any framework at the bottom of the suspended refractory curtain wall assembly, but to allow the refractory surfaces to be exposed thereby eliminating any need for protection of a support structure from heat.

It is readily apparent that vertically suspended refractory curtain wall assemblies according to this invention may be constructed in a wide variety of sizes for various high temperature purposes, such as a front wall for a slot furnace where it is necessary to provide an opening above the hearth to allow material to be inserted and withdrawn; as entrance and exit walls in a pusher furnace where material is pushed in one end and out the other; or in conjunction with a suspended roof to form side walls of an enclosure which can be raised or lowered.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

I claim:

1. In a vertically suspended refractory curtain wall comprising two courses of refractory shapes; a first course comprising a plurality of adjacent horizontal rows each comprising a plurality of side-by-side rectangular refractory shapes each having a solid rectangular flat exposed face and an opposite face having a horizontal central through recess parallel to a plane of said refractory curtain wall and portions extending above and below said recess, the portion of the refractory extending above said recess forming an upper horizontal hanger portion and the portion of the refractory extending below said recess forming a lower horizontal hanger portion; and a second course comprising a plurality of adjacent horizontal rows each comprising a plurality of side-by-side rectangular refractory shapes each having a solid rectangular flat exposed face and an opposite face having a horizontal central through recess parallel to a plane of said refractory curtain wall and portions extending above and below said recess, the portion of the refractory extending above said recess forming an upper horizontal hanger portion and the portion of the refractory extending below said recess forming a lower horizontal hanger portion; said lower horizontal hanger portions of one said horizontal row of said first course refractories fitting within the upper portion of said horizontal recesses of one said horizontal row of said second course refractories, thereby suspending said second course refractories and said upper horizontal hanger portions of an adjacent lower said horizontal row of said first course refractories fitting within the lower portion of the same said horizontal recesses of said second course refractories thereby suspending said adjacent lower horizontal row of said first course refractories.

2. In a vertically suspended refractory curtain wall of claim 1 wherein the vertical joints between said side-by-side refractories of said first course are horizontally displaced from the vertical joints between said side-by-side refractories of said second course.

3. In a vertically suspended refractory curtain wall of claim 2 wherein said vertical joints are displaced by an amount equal to about one-half the width of said refractory shapes.

4. In a vertically suspended refractory curtain wall of claim 1 wherein the refractories of said first course are of a different quality than said refractories of said second course.

5. In a vertically suspended refractory curtain wall of claim 1 wherein walls of said upper hanger portions and said lower hanger portions forming said recesses taper thereby providing greater height to said recesses toward the central portions of said refractories.

6. In a vertically suspended refractory curtain wall of claim 5 wherein the depth of said recesses is about one-half the thickness of said refractory shapes.

7. In a vertically suspended refractory curtain wall of claim 1 wherein the vertical joints between said side-by-side refractories of said first course are horizontally displaced from the vertical joints between said side-by-side refractories of said second course and the walls of said upper hanger portions and said lower hanger portions forming said recesses taper thereby providing greater height to said recesses toward the central portions of said refractories.

8. A vertically suspended refractory curtain wall assembly comprising:

a support hanger comprising a hanger means;

a plurality of side-by-side rectangular refractory shapes forming an upper row of a first course and each having a solid rectangular flat exposed face an opposite face having a horizontal central through recess parallel to a plane of said refractory curtain wall and portions extending above and below said recess, the portion of the refractory extending above said recess forming an upper horizontal hanger portion and the portion of the refractory extending below said recess forming a lower horizontal hanger portion, said hanger means fitting within the upper portion of said horizontal recesses thereby suspending said upper row of said first course;

a plurality of side-by-side rectangular refractory shapes forming an upper row of a second course each having a solid rectangular flat exposed face and an opposite face having a horizontal central through recess parallel to a plane of said refractory curtain wall and portion extending above and below said recess, the portion of the refractory extending above said recess forming an upper horizontal hanger portion and the portion of the refractory extending below said recess forming a lower horizontal hanger Portion, said lower horizontal hanger portions of said upper row of said first course refractories fitting within the upper portion of said horizontal recesses and engaging said upper horizontal hanger portions of said upper row of said second course refractories thereby suspending said upper row of second course refractories;

a plurality of side-by-side rectangular refractory shapes forming a second row of said first course adjacent said upper row of said first course each having a solid rectangular flat exposed face and an opposite face having a horizontal central through recess parallel to the plane of said refractory curtain wall and portions extending above and below said recess, the portion of the refractory extending above said recess forming an upper horizontal hanger portion and the portion of the refractory extending below said recess forming a lower horizontal hanger portion, said upper horizontal hanger portions of said second row refractory shapes fitting within the lower portion of said horizontal recesses of said upper row of said second course refractory shapes thereby suspending said second row of first course refractories; and continuing horizontal rows of said first and said second course refractories until the desired curtain wall height is reached, said curtain wall refractory shapes suspended from said hanger means.

9. A vertically suspended refractory curtain wall assembly of claim 8 wherein the vertical joints between said side-by-side refractories of said first course are horizontally displaced from the vertical joints between said side-by-side refractories of said second course.

10. A vertically suspended refractory curtain wall assembly of claim 9 wherein said vertical joints are displaced by an amount equal to about one-half the width of said refractory shapes.

11. A vertically suspended refractory curtain wall assembly of claim 8 wherein the refractories of said first course are of a different quality than said refractories of said second course.

12. A vertically suspended refractory curtain wall assembly of claim 8 wherein walls of said upper hanger portions and said lower hanger portions forming said recesses taper thereby providing greater height to said recesses toward the central portions of said refractories.

13. A vertically suspended refractory curtain wall assembly of claim 12 wherein the depth of said recesses is about one-half the thickness of said refractory shapes.

14. A vertically suspended refractory curtain wall assembly of claim 8 wherein the vertical joints between said side-by-side refractories of said first course are horizontally displaced from the vertical joints between said side-by-side refractories of said second course and the walls of said upper hanger portions and said lower hanger portions forming said recesses taper thereby providing greater height to said recesses toward the central portions of said refractories.

15. A vertically suspended refractory curtain wall assembly of claim 8 wherein the end refractories of one said course are vertical half refractories.

16. A vertically suspended refractory curtain wall assembly of claim 8 wherein the lowermost said horizontal row of said first course is horizontal half refractories.

17. A vertically suspended refractory curtain wall assembly of claim 8 wherein the ends of said assembly comprises the ends of said refractories without framing.

18. A vertically suspended refractory curtain wall assembly of claim 8 wherein said support hanger is fluid cooled.

19. A vertically suspended refractory curtain wall assembly of claim 8 wherein the vertical joints between said side-by-side refractories of said first course are horizontally displaced from the vertical joints between said side-by-side refractories of said second course, the walls of said upper hanger portions and said lower hanger portions forming said recesses taper thereby providing greater height to said recesses toward the central portions of said refractories, the end refractories of one said course are vertical half refractories, and the lowermost said horizontal row of said first course is horizontal half refractories.

20. A vertically suspended refractory curtain wall assembly of claim 19 wherein the ends of said assembly comprise the ends of said refractories without framing and said support hanger is fluid cooled.

* * * * *